United States Patent [19]

Lee

[11] Patent Number: 4,724,976

[45] Date of Patent: Feb. 16, 1988

[54] COLLAPSIBLE CONTAINER

[76] Inventor: Alfredo A. Lee, 2333 Kapiolani Blvd., #2305, Honolulu, 96826

[21] Appl. No.: 2,066

[22] Filed: Jan. 12, 1987

[51] Int. Cl.[4] ..... B65D 8/14

[52] U.S. Cl. ..... 220/8

[58] Field of Search ..... 220/8, 326; 215/1.5

[56] References Cited

U.S. PATENT DOCUMENTS

| | | | |
|---|---|---|---|
| 1,299,866 | 4/1919 | Smith | 220/326 |
| 1,934,138 | 11/1933 | Paul | 220/8 |
| 2,517,254 | 8/1950 | Steele | 220/8 |
| 2,546,452 | 3/1951 | Kmieliauskas | 220/8 |
| 2,564,862 | 8/1951 | Stopinski | 220/8 |
| 3,338,388 | 8/1967 | Igoe | 220/8 |
| 3,426,928 | 4/1969 | Swerbinsky | 220/8 |

FOREIGN PATENT DOCUMENTS

| | | | |
|---|---|---|---|
| 1015014 | 11/1955 | France | 220/8 |
| 21757 | 8/1961 | German Democratic Rep. | 220/8 |
| 70356 | 12/1969 | German Democratic Rep. | 206/1.5 |

*Primary Examiner*—George E. Lowrance

*Attorney, Agent, or Firm*—Henderson & Sturm

[57] ABSTRACT

A collapsible container having upper and lower vertically telescopically related parts, the upper part having an open bottom through which the lower part is received. Cooperative wall portions of the parts have cooperative lips to establish stops for achieving the extended (raised) position of the top part and collapsed (top part lowered) condition of the parts. Projectable and retractable lock mechanism is accessible from exteriorly of the container and operates to latch the parts in extended condition.

2 Claims, 3 Drawing Figures

Fig. 1
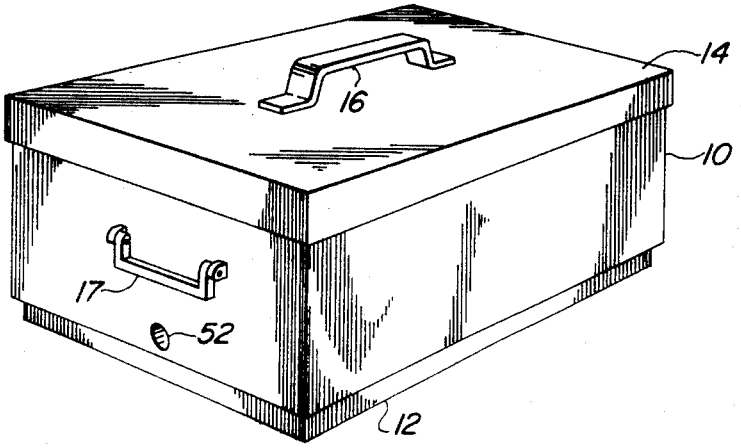
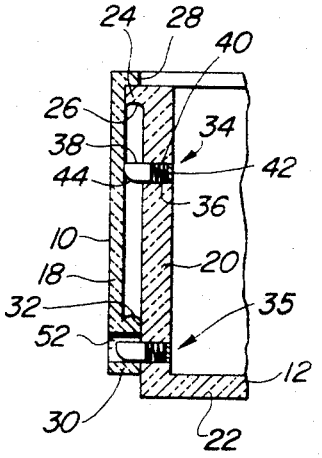
Fig. 2
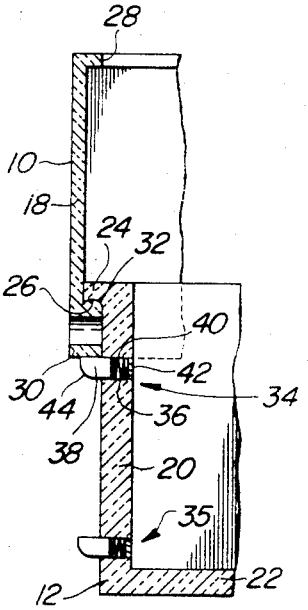
Fig. 3

COLLAPSIBLE CONTAINER

BACKGROUND AND SUMMARY OF THE INVENTION

Several forms of collapsible containers are known, including those of the drinking cup style in which truncated conical bands are related for extension and collapse. Some types of containers rely on manipulation of latches, etc. for achieving collapsed and extended positions, the aims being primarily to vary volume, conserve space, etc. One form of container with latchable walls is found in the U.S. Pat. No. 2,518,343, to Lindstrom which is in the form of a typical lunch box having variable-volume lower parts and a fixed-volume top part for carrying an insulated beverage container, for example. In that patent, rather complicated latch means is provided in connection with changing the volume of the lower parts. Further, this latch means is operative from within the box and thus interferes with packing and unpacking the box contents.

According to the present invention, a simplified construction is provided, including latch means operative from outside the container and cooperative interengageable lip means for defining stops regulating the extent of relative vertical movement between the upper and lower container parts. The latch means is of the bias-projectable type that can be forcibly overridden when changing from collapsed condition to extended condition, and which may be manually depressed to enable return to collapsed condition. A further object is to provide interfitting lips respectively on the movable parts, which engage to effect a substantial seal or seal-like relationship in the extended mode of the container.

Further features and advantages of the invention will appear as a preferred embodiment thereof is disclosed in detail in the ensuing description and accompanying sheet of drawings.

BRIEF DESCRIPTION OF THE DRAWINGS

FIG. 1 is a perspective of a representative form of container to which the invention may be applied.

FIG. 2 is an enlarged view, fragmentary in nature, showing cooperative wall parts of the upper and lower container parts as they appear in collapsed condition.

FIG. 3 is a similar view showing the parts in their extended mode.

DETAILED DESCRIPTION OF A PREFERRED EMBODIMENT OF THE INVENTION

FIG. 1 is representative of a container to which the invention is applicable. The container comprises an upper container part 10 and a cooperative lower container part 12, both of which may be composed of any suitable material, preferably having insulting properties as where the invention is employed with a beverage or like cooler. The upper part is shown as being closed by a removable cover 14. Although the structure is generally orthogonal in configuration, this is not a limitation on the invention, for many other shapes may be improved by the invention. Also, any form of means (not shown) may be used to attach the cover so that the entire unit may be carried via a top handle 16 or end handles 17.

In FIGS. 2 and 3, only portions of the walls of the container parts have been selected for purposes of illustration. To this end, then, the upper part 10 is shown as having an upright wall 18, which may be peripheral.

This upper part has an open or no bottom because it must vertically telescopically receive the lower container part 12, a part of a wall 20 of which is shown as being closely parallel to and laterally or horizontally spaced from the upper wall 18. The spacing occurs because of lip structure to be defined. The container lower part has a closed bottom 22.

The lower part wall 20 has an upper edge portion including an integral lip 24 which projects laterally toward and closely fits the interior surface of the upper wall 18. Depending upon the nature of the total container as to use, type of contents, etc., the lip may be peripheral. In any event, the illustration shows what is involved, especially as to cooperation with the top wall in extension and collapse of the container. The under side of the lip is concave or recessed at 26 for purposes to presently appear. The upper part wall has upper and lower edge portions providing integral lips 28 and 30, respectively, that project laterally inwardly toward the lower wall 20. As best seen in FIGS. 2 and 3, the lower lip 30 rides the outer surface of the lower wall 20. When the parts are assembled, the upper lip 28 is above and the lower lip 30 is below the lip 24 on the lower wall 20. When the container parts are collapsed (FIG. 2) the under part of the upper lip rests on top of the lower wall lip 24. When the parts are extended, the upper portion of the upper wall lower lip 30, which is rounded at 32 to interfit with the concave configuration 26 of the lip 24, engages the lip 24 (FIG. 3). Thus the three lips cooperate to define stops or limits on relative vertical movement of the container parts. Of course, the dimensions of the elements may be varied to vary the extent of extension and collapse. The interfit of the lip portions 26 and 32 not only stabilizes the container parts when extended but may be exploited as a seal, especially when the lips are continuously peripheral.

In order to retain the container parts in extended mode, upper and lower releasable latch or lock means are provided, indicated generally by the numerals 34 and 35. In this case, the lower wall 20 has a horizontal upper bore 36 which slidably carries a cylindrical detent 38 backed up by a coil spring 40 which reacts again a plug 42 in the bore so as bias the detent in an outwardly projected position. The exposed under part of the detent is shaped as a cam 44 to enable the spring-loaded detent to be overridden by manual force applied to the upper container part when it is raised to extended position (FIG. 3). There may be several latches spaced about the container, depending upon the size, intended use, etc. of the container. As seen the projected detent engages under the upper wall lower lip and retains the raised position of the upper container part. When it is desired to collapse the container, the detent, being accessible from the outside of the container, is easily manually depressed and upper container part may be readily returned to collapsed condition (FIG. 2).

The lower or second means includes a spring-loaded detent 46 carried in a bore 48 in the wall 20 and projectable into a bore 50 in the wall 18. The cam on the detent 46 is reversed as respects that on the detent 38. A hole 52 is provided in the wall 18 to provide access to release the detent 46 when the box is collapsed.

Features and advantages of the invention, in addition to those noted above, will be readily apparent to those versed in the art, as will many modifications in the structure disclosed, all of which may be achieved without departure from the spirit and scope of the invention.

I claim:

1. A collapsible and extensible container including upper and lower container parts in which a lower part fits vertically telescopically within an open-bottom upper part and in which the upper and lower parts respectively have upper and lower upright walls closely spaced horizontally apart, characterized in that the lower wall has an upper portion including an integral lip projecting outwardly toward the upper wall and the upper wall has integral upper and lower lips projecting inwardly toward the lower wall and spaced vertically apart respectively above and below the lower wall lip to cooperate with the lower lip in defining upper and lower stops representing, respectively, extended and collapsed positions of the container parts, laterally projectable and retractable upper lock means carried by the lower wall in downwardly spaced relation to the lower wall lip, said means being retractable to be passed upon upward movement of the upper container from its collapsed position to its extended position and projectable to engage beneath the upper wall lower lip to retain said extended position of the upper container part, said means being retractable from beneath the upper wall lower lip to enable return of the upper container part to its collapsed position, and lower releasable lock means carried by the lower wall below the upper means and releasably engageable with the upper wall when the upper container part is in its collapsed condition, whereby to lock the contained parts together in their collapsed position.

2. A container according to claim 1, in which the lower lock means includes an opening in the upper wall adjacent to the upper wall lower lip and a detent carried by the lower wall for selective engagement with and disengagement from the opening.

* * * * *